US007207371B2

(12) United States Patent
Hsu

(10) Patent No.: US 7,207,371 B2
(45) Date of Patent: Apr. 24, 2007

(54) ROLLER BLIND STRUCTURE

(75) Inventor: Ben Hsu, Changhua Hsien (TW)

(73) Assignee: Cheng Feng Blinds Ind. Co., Ltd., Changhua Hsien (TW)

( * ) Notice: Subject to any disclaimer, the term of this patent is extended or adjusted under 35 U.S.C. 154(b) by 322 days.

(21) Appl. No.: 10/936,555

(22) Filed: Sep. 9, 2004

(65) Prior Publication Data

US 2006/0021713 A1 Feb. 2, 2006

(30) Foreign Application Priority Data

Jul. 30, 2004 (TW) ..... 93212118 U

(51) Int. Cl.
*A47H 1/00* (2006.01)
*E06B 9/08* (2006.01)

(52) U.S. Cl. ..... 160/85; 160/121.1; 160/120

(58) Field of Classification Search ..... 160/121.1, 160/120, 122, 85, 86, 241
See application file for complete search history.

(56) References Cited

U.S. PATENT DOCUMENTS 2,142,822 A * 1/1939 Moore ..... 160/120
2,280,358 A * 4/1942 Tietig ..... 160/120
5,664,613 A * 9/1997 Jelic ..... 160/84.05
6,189,592 B1 * 2/2001 Domel ..... 160/85
6,672,361 B2 * 1/2004 Fransen ..... 160/85
6,688,369 B2 * 2/2004 Colson et al. ..... 160/121.1
7,059,377 B2 * 6/2006 Nien et al. ..... 160/120
7,059,378 B2 * 6/2006 Colson et al. ..... 160/121.1

* cited by examiner

*Primary Examiner*—Hugh B. Thompson, II
*Assistant Examiner*—Candace L. Bradford
(74) *Attorney, Agent, or Firm*—Troxell Law Office, PLLC

(57) ABSTRACT

A novel roller blind structure includes a roller blind made up of a roller shaft, a side winder with a linkage member attached at both ends of the roller shaft respectively to be actuated by an operating member, and a pivoting post respectively protruding at the outer side of the side winder and the linkage member thereof to be mounted to an upper beam thereby wherein, when pulled by the operation member thereof, the side winders and the linkage member will actuate the roller shaft to rotate either clockwise or counterclockwise accordingly so as to control the rolling or unrolling operation of a blind body having an extension piece of a proper length preset at the lower section thereof to be wound backwards and led upwards to be levelly fixed to the inner wall of the upper beam thereof. A counterweight member is retained at the curving turn of the blind body thereof to neatly separate in space the extension piece thereof from a decoration piece disposed at the front section of the blind body thereon. Both the extension piece and the decoration piece of the blind body are respectively equipped with a plurality of light-passable areas alternatively arranged with a plurality of black-out areas disposed at the surface thereon. Via the winding operation of the roller shaft thereof, the blind body can be flexibly adjusted to have it both ways with partial light and partial black-out effect, or to display in a complete black-out status for light control and privacy purpose to achieve best using condition and versatile changes of the present invention.

5 Claims, 4 Drawing Sheets

ROLLER BLIND STRUCTURE

BACKGROUND OF THE INVENTION

The present invention is related to a novel roller blind structure, including a blind body made up of an extension piece of a proper length preset at the lower section thereof to be wound backwards and led upwards to be levelly fixed to the inner wall of an upper beam thereof, and a counterweight member precisely retained at the curving turn of the blind body thereof to neatly separate in space the extension piece thereof from a decoration piece disposed at the front section of the blind body wherein both the extension piece and the decoration piece thereof are respectively equipped with a plurality of light-passable areas alternatively arranged with a plurality of black-out areas; whereby, via the winding operation of a roller shaft mounted at the upper beam thereof, the blind body can be flexibly adjusted to have it both ways with partial light and partial black-out effect at the same time, or to display in a complete black-out status for light control and privacy purpose to achieve best using condition and versatile changes of the present invention.

Please refer to FIG. 1. A conventional roller blind 10 is made up of a blind body 11 simply wound around a roller shaft 12 and suspended downwards there-from. A counterweight member 13 is led through the bottom edge of the blind body 11 and retained therein. In the rolling or unrolling operation thereof, the blind body 11 is directly suspended downwards at the underside of the roller shaft 12 in a single piece. Thus, the blind body 11 is rather monotonously made in either a light-passable fabric or a black-out fabric without the versatility to have it both ways.

SUMMARY OF THE PRESENT INVENTION

It is, therefore, the primary purpose of the present invention to provide a novel roller blind structure, including a blind body made up of an extension piece of a proper length preset at the lower section thereof to be wound backwards and led upwards to be levelly fixed to the inner wall of an upper beam thereof, and a counterweight member precisely retained at the curving turn of the blind body thereof to neatly separate in space the extension piece thereof from a decoration piece disposed at the front section of the blind body wherein both the extension piece and the decoration piece thereof are respectively equipped with a plurality of light-passable areas alternatively arranged with a plurality of black-out areas; whereby, via the winding operation of a roller shaft mounted at the upper beam thereof, the blind body can be flexibly adjusted to have it both ways with partial light and partial black-out effect at the same time, or to display in a complete black-out status for light control and privacy purpose to achieve best using condition and versatile changes of the present invention.

DETAILED DESCRIPTION OF THE PREFERRED EMBODIMENTS

Figure 1:
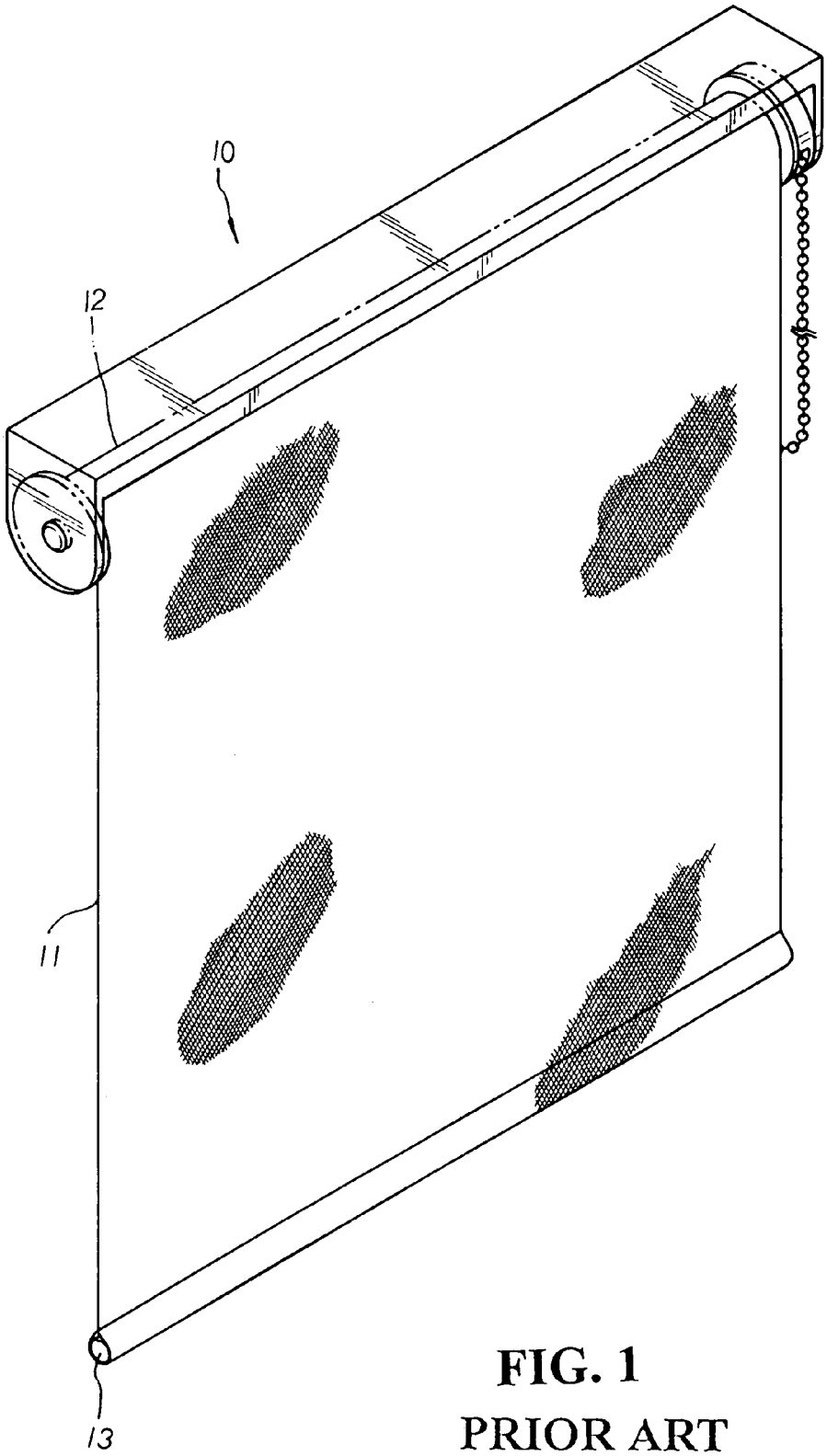
FIG. 1 PRIOR ART
FIG. 1 is a perspective view of a conventional roller blind structure.
Figure 2:
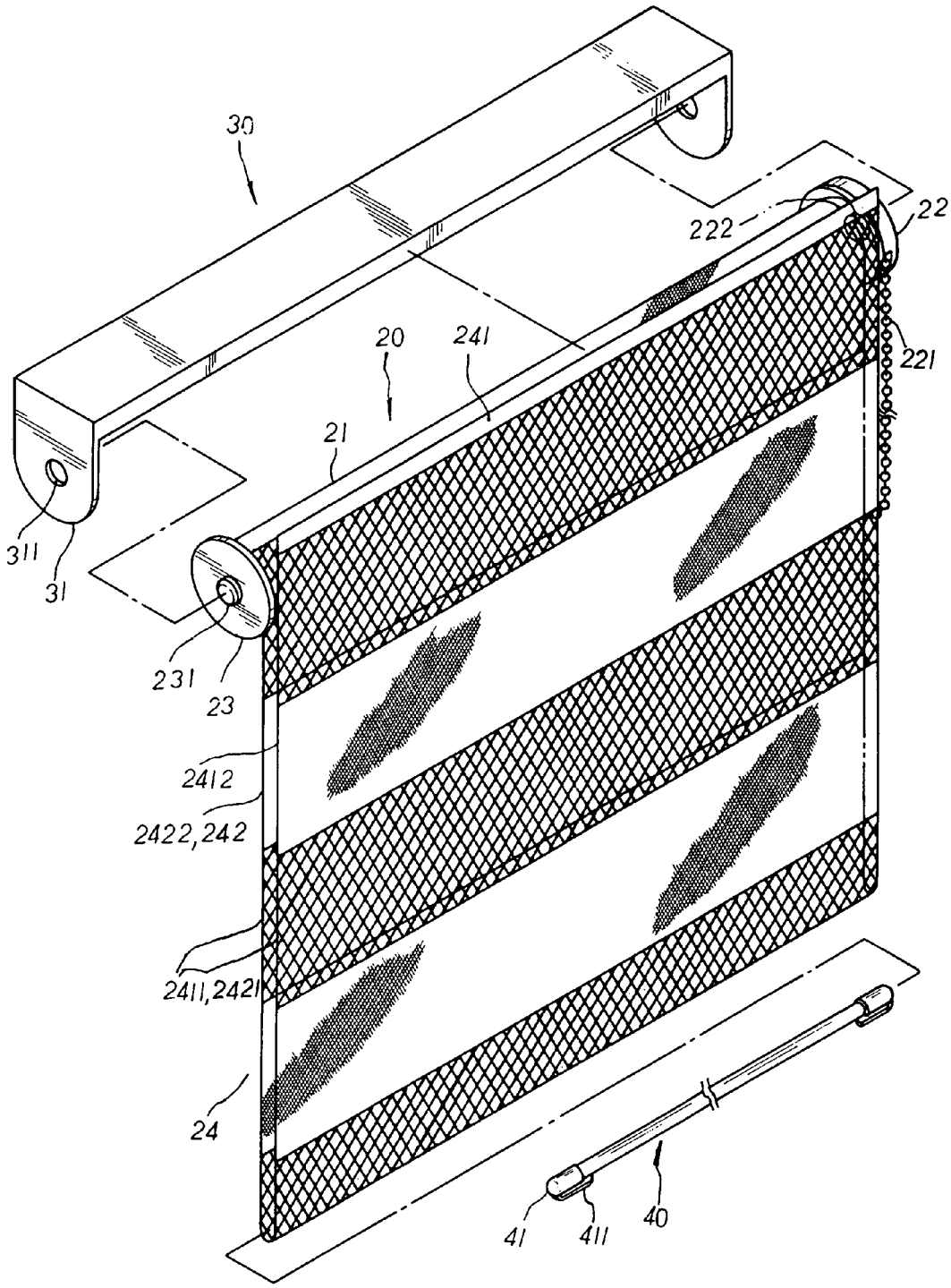
FIG. 2 is a perspective exploded view of the present invention.
Figure 3:
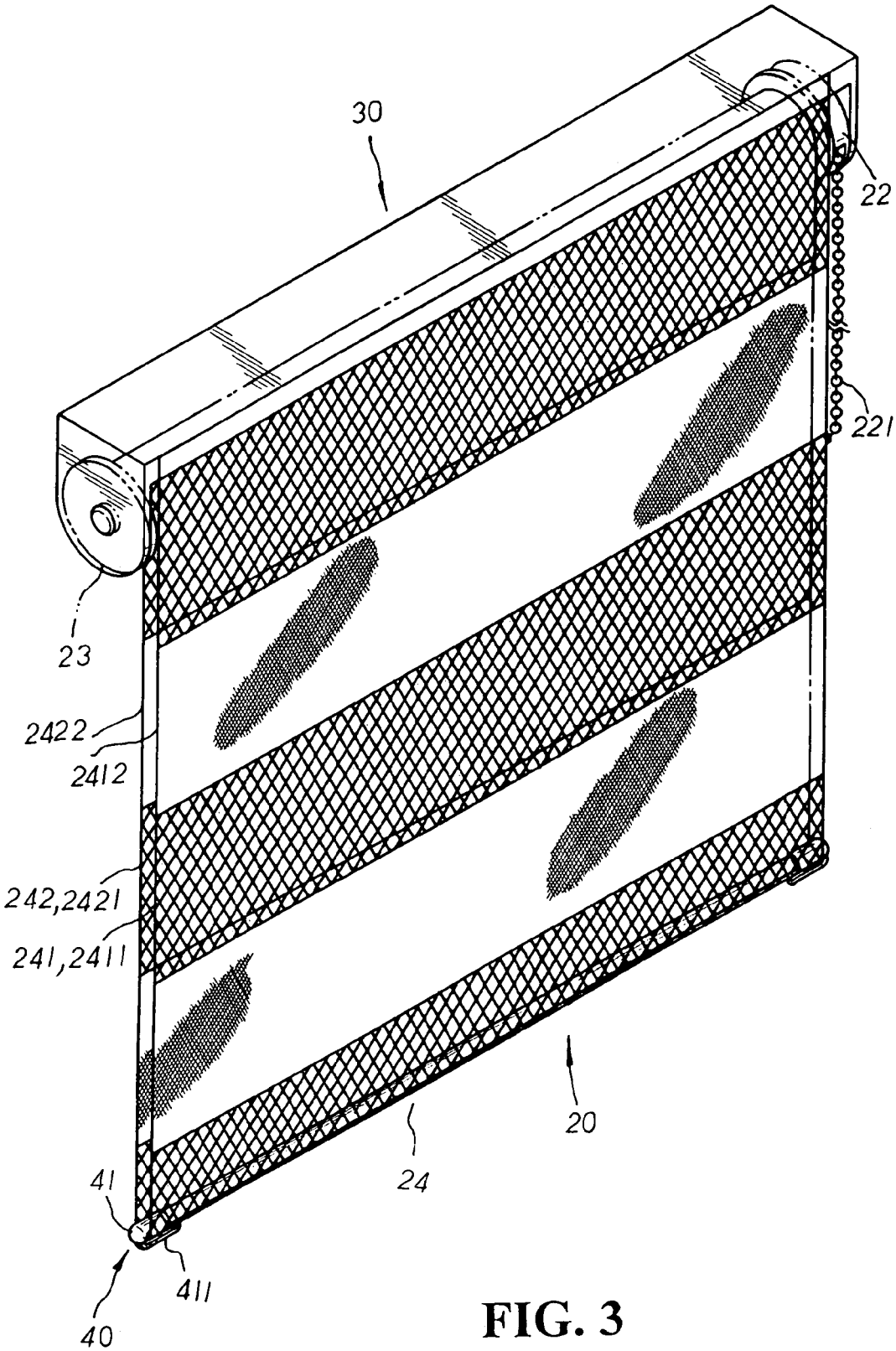
FIG. 3 is a diagram showing the operation of the present invention in assembly.

Please refer to FIGS. 2 to 3 inclusive. The present invention is related to a novel roller blind structure, including a roller blind 20 made up of a roller shaft 21, a side winder 22 with a linkage member 23 attached at both ends of the roller shaft 21 respectively to be actuated by an operating member 221 such as a beaded chain, and a pivoting post 222, 231 protruding at the outer side of the side winder 22 and the linkage member 23 thereof to be mounted into an assembly hole 311 disposed at both left/right side plates 31 of an upper beam 30 respectively. Thus, when pulled by the operation member 221 thereof, the side winders 22 and the linkage member 23 will actuate the roller shaft 21 to rotate either clockwise or counterclockwise accordingly so as to control the rolling or unrolling operation of a blind body 24 thereby. The blind body 24 is provided with an extension piece 241 of a proper length preset at the lower section thereof that is wound backwards and led upwards to be levelly attached via fastening or fixing means to the inner wall of the upper beam 30 thereof. A counterweight member 40 having a limiting clip 41 disposed at both ends thereof respectively is retained at the curving turn of the blind body 24 thereof to neatly separate in space the extension piece 241 thereof from a decoration piece 242 disposed at the front side of the blind body 24 thereof with the adjacent lateral edges of the blind body 24 thereof precisely located at the limiting clips 41 therein. The extension piece 241 and the decoration piece 242 of the blind body 24 are respectively equipped with a plurality of light-passable areas 2411, 2421 of net-like or transparent lace surface alternatively arranged with a plurality of black-out areas 2412, 2422 wherein the height of each black-out area 2412, 2422 is slightly higher than that of each light-passable area 2411, 2421 thereof.

In practical use, when the light-passable areas 2421, 2411 of the decoration piece 242 and the extension piece 241 of the blind body 24 thereof are correspondingly juxtaposed one to another in arrangement as shown in FIG. 3, sunlight or moonbeam is partially allowed to filter through the blind body 24 and come indoors via the light-passable areas 2421, 2411 with a transparent effect thereof. And via the light-passable areas 2421, 2411 thereof, one can easily see the view outside without the blind body 24 being rolled upwards for the purpose thereof. Besides, due to the black-out areas 2422, 2412 alternatively arranged with the light-passable areas 2421, 2411 thereof, light filtering through the blind body 24 thereof is partially sheltered by the black-out areas 2422, 2412 in interval, softening the dazzling sunlight during the daytime to provide a gentle transparent effect as well as blocking out the moonbeam in contrast with the light filtering through the light-passable areas 2421, 2411 to provide a unique shading effect thereof.

Figure 4:
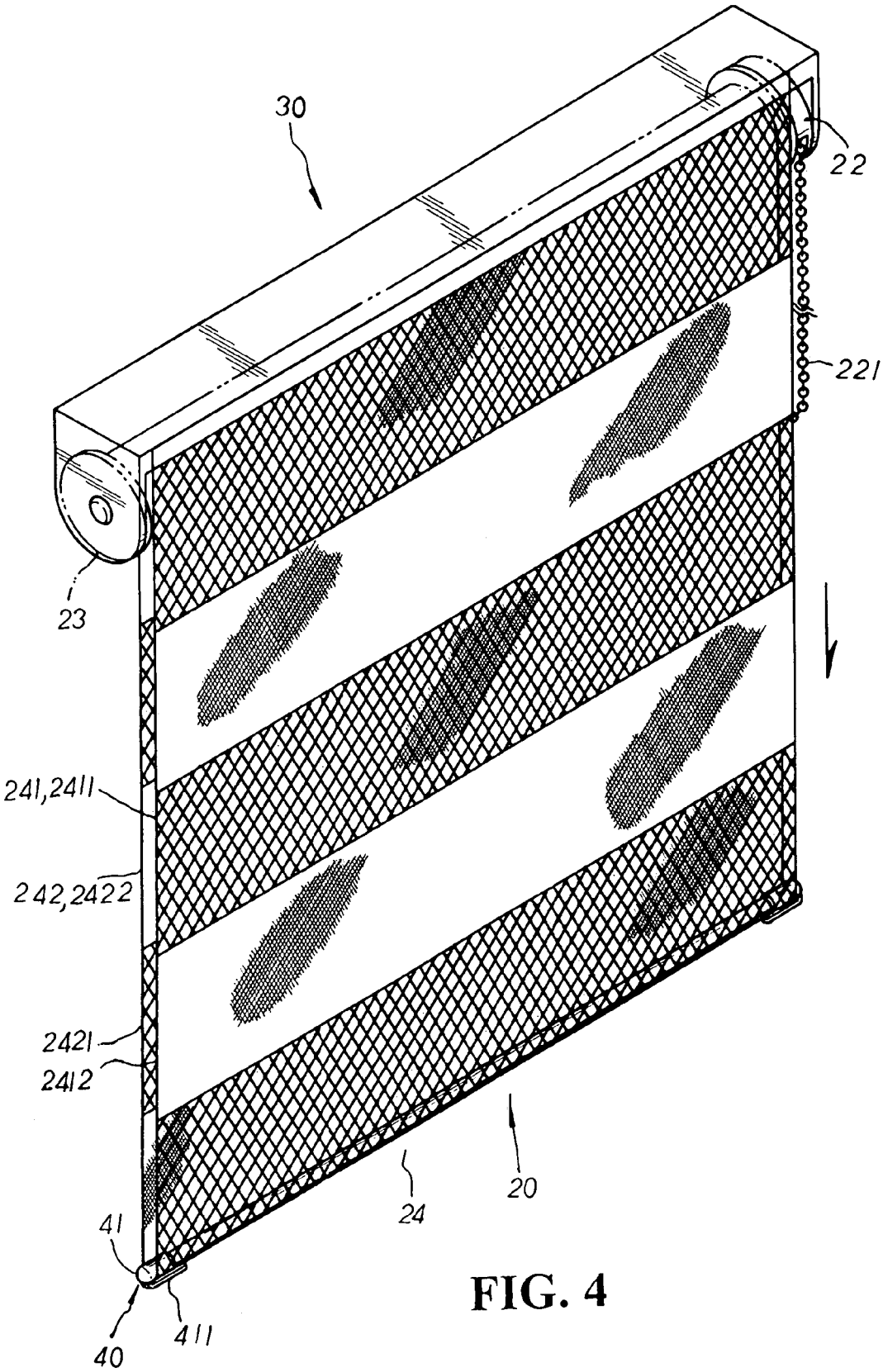
FIG. 4 is another diagram showing the present invention in practical use.

Please refer to FIG. 4. When the blind body 24 is wound via the operating member 221 till the black-out areas 2422 of the decoration piece 242 are correspondingly juxtaposed with the light-passable areas 2411 of the extension piece 241 thereof in arrangement, the light-passable areas 2421 of the decoration piece 242 are precisely sheltered by the black-out areas 2412 of the extension piece 241 respectively, completely blocking all view and light outdoors to achieve universal sheltering and light control effect thereof.

What is claimed is:

1. A roller blind structure, including a roller blind made up of a roller shaft, a side winder with a linkage member attached at both ends of the roller shaft respectively to be actuated by an operating member, and a pivoting post protruding at an outer side of the side winder and the linkage member thereof to be mounted into an assembly hole disposed at both left and right side plates of an upper beam respectively; when pulled by the operation member thereof, the side winder and the linkage member will actuate the roller shaft to rotate either clockwise or counterclockwise accordingly so as to control the rolling or unrolling operation of a blind body thereby; being characterized by that, the blind body having an extension piece of a proper length preset at a lower section thereof that is wound backwards and led upwards to be levelly fixed at an inner wall of the upper beam thereof; a counterweight member being retained at the curving turn of the blind body thereof to neatly separate in space the extension piece thereof from a decoration piece disposed at the front section of the blind body; both the extension piece and the decoration piece of the blind body being respectively equipped with a plurality of light-passable areas alternatively arranged with a plurality of black-out areas disposed at a surface thereon.

2. The roller blind structure as claimed in claim 1 wherein the extension piece of the blind body is securely attached to the upper beam via fastening or fixing operation thereby.

3. The roller blind structure as claimed in claim 1 wherein the light-passable areas of the blind body can be made in net-like or transparent lace surface.

4. The roller blind structure as claimed in claim 1 wherein the counterweight member thereof has a limiting clip disposed at both ends thereof respectively for retaining an adjacent lateral edge of the blind body thereby.

5. The roller blind structure as claimed in claim 1 wherein the height of each black-out area of the blind body thereof is slightly higher than that of each light-passable area thereof.

* * * * *